US008029103B2

(12) United States Patent
Kanda

(10) Patent No.: US 8,029,103 B2
(45) Date of Patent: Oct. 4, 2011

(54) LIQUID DROPLET EJECTION HEAD FOR EJECTING HIGH VISCOSITY LIQUID DROPLETS, AND LIQUID DROPLET EJECTION DEVICE

(75) Inventor: Torahiko Kanda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 466 days.

(21) Appl. No.: 12/195,563

(22) Filed: Aug. 21, 2008

(65) Prior Publication Data

US 2009/0189955 A1 Jul. 30, 2009

(30) Foreign Application Priority Data

Jan. 29, 2008 (JP) ..... 2008-017527

(51) Int. Cl.
*B41J 2/06* (2006.01)

(52) U.S. Cl. ..... 347/55; 347/48; 347/54

(58) Field of Classification Search ..... 347/20, 347/54, 55, 68, 70, 71, 72
See application file for complete search history.

(56) References Cited

U.S. PATENT DOCUMENTS

| | | | |
|---|---|---|---|
| 6,644,786 | B1 | 11/2003 | Lebens |
| 2006/0098049 | A1 | 5/2006 | Kanda |
| 2006/0098054 | A1 | 5/2006 | Kanda |
| 2008/0018707 | A1 * | 1/2008 | Masuyama et al. ..... 347/55 |

FOREIGN PATENT DOCUMENTS

| | | |
|---|---|---|
| EP | 0265114 | 4/1988 |
| JP | 63-099952 | 5/1988 |
| JP | 9-327918 | 12/1997 |
| JP | 10-217477 | 8/1998 |
| JP | 2003-118114 | 4/2003 |
| JP | 2003-220702 | 8/2003 |
| JP | 2004-034710 | 2/2004 |
| JP | 2006-130780 | 5/2006 |
| JP | 2006-130781 | 5/2006 |
| JP | 2006-130782 | 5/2006 |
| JP | 2006-130783 | 5/2006 |

* cited by examiner

*Primary Examiner* — Juanita D Stephens
(74) *Attorney, Agent, or Firm* — Fildes & Outland, P.C.

(57) ABSTRACT

The present invention provides a liquid droplet ejection head that ejects droplets of high viscosity ink. A liquid droplet of an electrically conductive liquid in the liquid droplet ejection head is ejected from the head, which is provided with difference in potential between the head and an opposing medium, toward the medium. Electricity is conducted between the head and the medium through a tail of the liquid droplet.

8 Claims, 8 Drawing Sheets

LIQUID DROPLET EJECTION HEAD FOR EJECTING HIGH VISCOSITY LIQUID DROPLETS, AND LIQUID DROPLET EJECTION DEVICE

CROSS-REFERENCE TO RELATED APPLICATION

This application is based on and claims priority under 35 USC 119 from Japanese Patent Application No. 2008-017527 filed Jan. 29, 2008.

BACKGROUND

1. Technical Field

The present invention relates to a liquid droplet ejection head, and in particular to a liquid droplet ejection head that ejects droplets of high viscosity ink.

2. Related Art

In liquid droplet ejection devices of currently marketed water-based ink jet printers, dye inks and pigments inks are used with a viscosity generally around 5 cps, and of the order of 10 cps at the most. It is known that printing ability can be improved by increasing ink viscosity, in order to prevent ink bleeding on impact with the printing medium, to increase the optical color density, and to reduce the amount of water contained therein so that swelling due to wetting of the medium can be suppressed and drying times can be reduced, or in order to increase the degrees of freedom in the overall design of such high quality inks.

However, a high powered pressure generation mechanism is required to eject high viscosity liquids, leading to detrimental effects on the cost, an increase in head size and the like.

The present inventors have previously submitted patent applications for liquid droplet ejection heads that impart compression and rotational movement to a beam and that use a sudden up-down movement when a buckling direction is reversed to separate by inertia a high viscosity liquid from a nozzle in the desired direction.

However, a tail of, for example, in excess of 1 mm is drawn out from a liquid droplet during ejection when a high viscosity liquid is ejected. In some cases the length of this tail becomes longer than the throw distance of the ejection head, and there are occasions when a tail is drawn out so as to bridge between the head and medium printed on. Consequently the impact shape of the liquid droplet is not a centrally symmetrical circular shape, but is shaped like a tadpole. In addition there is the problem that the tail remains after impact of the liquid droplet on the medium, delaying the stabilization of the meniscus on the nozzle surface, resulting in delays to the refilling of the nozzle, thereby impeding high frequency ejection.

As a result of investigating the above problems, the present inventors have discovered that by applying a voltage/difference in electrical potential between the head and a medium in a head for high viscosity liquid ejection, electricity is conducted through the drawn out tail portion, this being an effective method for heating the tail of the liquid droplet and positively and selectively severing the tail from the liquid droplet.

SUMMARY

In consideration of the above circumstances, the present invention provides a liquid droplet ejection head capable of ejecting high viscosity liquid droplets at room temperature at high driving frequencies and with high shape precision.

According to an aspect of the liquid droplet ejection head, a liquid droplet of an electrically conductive liquid is ejected from the head, which is provided with difference in potential between the head and an opposing medium, toward the medium, and electricity is conducted between the head and the medium through a tail of the liquid droplet.

BRIEF DESCRIPTION OF THE DRAWINGS

Exemplary embodiments of the present invention will be described in detail based on the following figures, wherein.

DETAILED DESCRIPTION

Basic Configuration

Figure 1A:
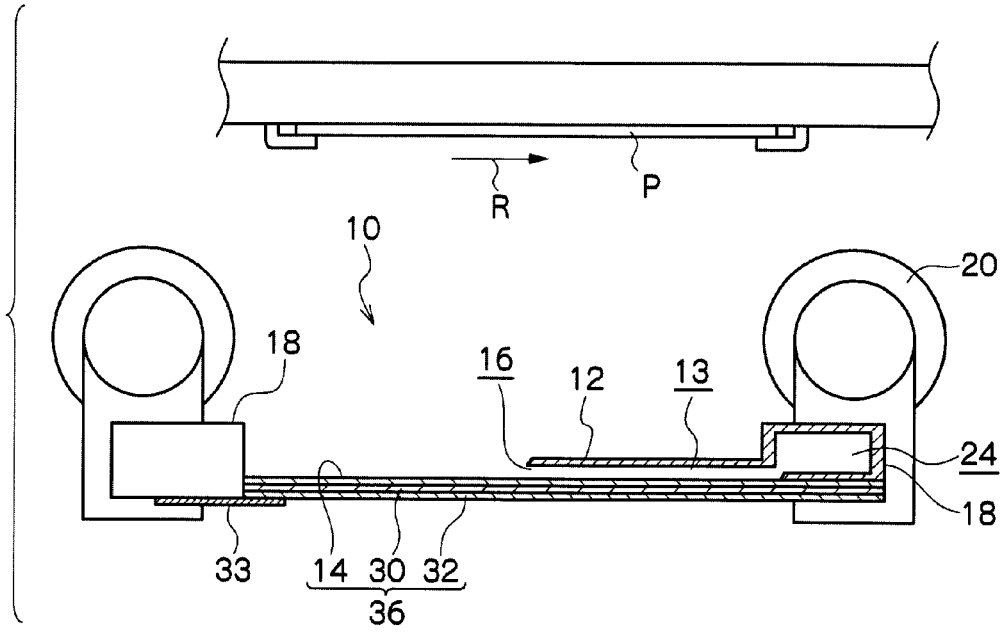
FIG. 1A is a diagram showing a liquid droplet ejection head according to an exemplary embodiment of the present invention.
Figure 1B:
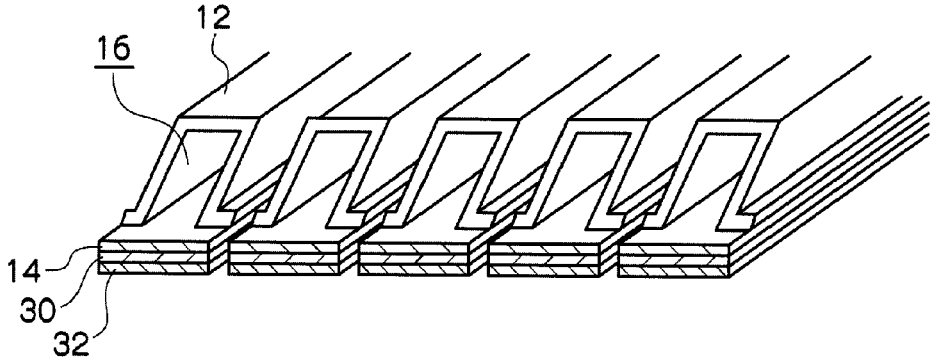
FIG. 1B is a diagram showing a portion of a liquid droplet ejection head according to an exemplary embodiment of the present invention.
Figure 2:
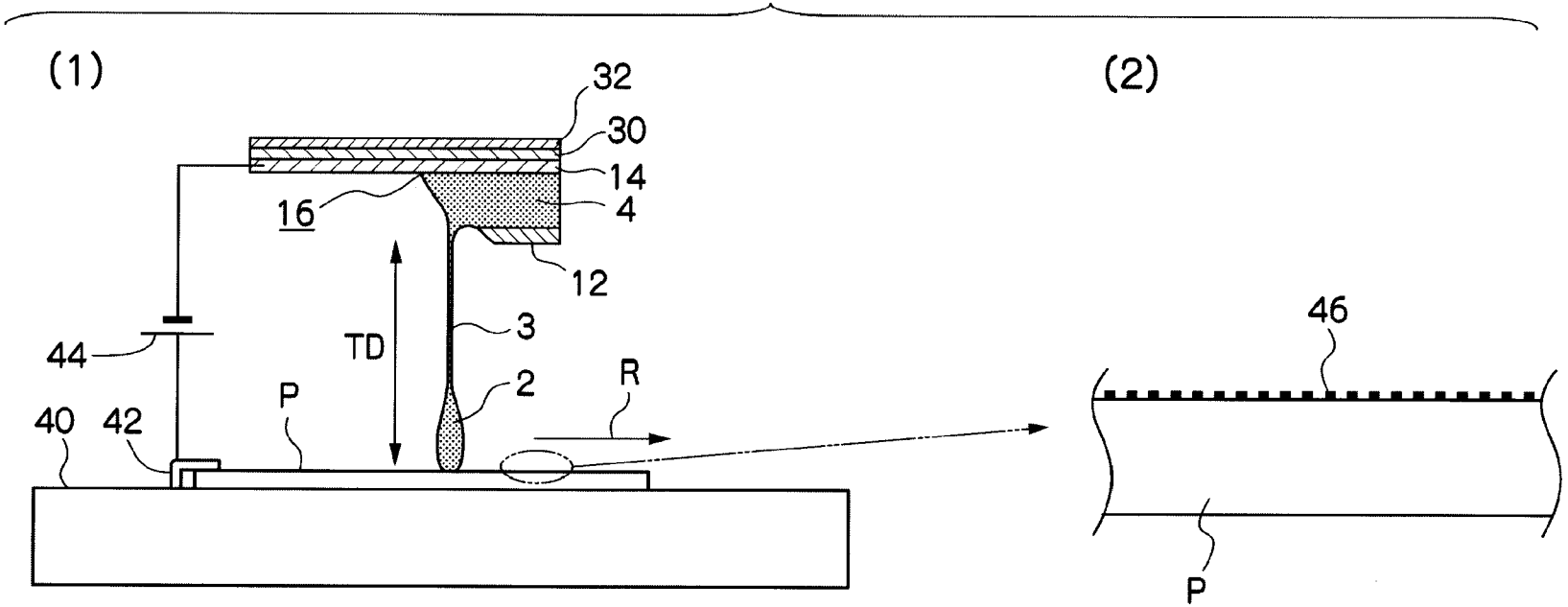
FIG. 2 is an expanded view of an expanded portion of the liquid droplet ejection head shown in FIG. 1A.

A liquid droplet ejection head according to a first exemplary embodiment of the present invention is shown in FIGS. 1A, 1B and 2.

As shown in FIGS. 1A and 1B, a liquid droplet ejection head 10 includes beam members 14, which are formed from a corrosion resistant material such as SUS, beam members 14 being supported at both ends in the length direction thereof by holding members 18. The holding members 18 are attached to rotation encoders 20, and beam members 14 are configured such that beam members 14 are pressed from both ends in the length direction as the rotation encoders 20 are rotationally moved, or such that force is applied in the bending direction and the beam members 14 are distorted in the liquid droplet ejection direction (toward the top in the figure) or in the direction opposite thereto.

Hollow pipe shaped flow channel members 12, provided with ducts 13, are provided as a unit at beam members 14, and extend from one end of the ejection surface side (the top in the figures) to approximately half the length of beam members 14. Nozzles 16 are provided at substantially the center of the beam members 14 in the length direction, the nozzles 16 forming ejection outlets of the ducts 13 provided at the end surface of the flow channel members 12. Nozzles 16 face a medium P that is to be subjected to liquid droplet ejection thereon.

Each of the beam members 14 is also joined to a thin plate shaped piezo element 30, and the piezo element 30 is in turn joined to an individual electrode 32. The beam members 14, the piezo element 30 and the individual electrode 32 configure to an actuator 36. The beam members 14 also serve as a common electrode for the piezo elements 30, and the beam members 14 and the individual electrodes 32 sandwich the piezo elements 30 therebetween. The beam members 14, also serving as the common electrode, are in contact with a liquid 4 that flows within the flow channel members 12 in the ducts 13, with the beam members 14 always in a conductible state (constantly connected).

When in this state, as shown in FIG. 1B, the plural beam members 14 arrayed in lines over the entire liquid droplet ejection head 10 contact the ducts 13, such that all of the ducts 13 can be applied all at once with an equipotential.

The liquid droplet ejection head 10 is disposed parallel to the surface of the medium P, with plural of the beam members 14 arrayed along a direction substantially orthogonal to the length direction of the beam members 14. Lines of dots are formed on the surface of the medium P by rows of liquid droplets ejected/expelled from nozzles 16, which are arrayed along a substantially straight line, onto the opposing surface of the medium P. A matrix of dots made up from the liquid droplets can consequently be formed over the entire opposing surface of the medium P by moving the medium P opposing the nozzles 16 in the conveying direction R.

In the present invention, as shown in (1) of FIG. 2, a specific voltage is applied between the beam members 14 and the medium P that is subject to liquid ejection/impact. Namely, for the medium P retained on a support member 40 by a retention member 42, an electrical supply 44 is connected between the beam members 14 and the retention member 42, applying a specific voltage therebetween. The medium P is also provided with an electrically conductive surface.

Since, as described above, the beam member 14 and the liquid 4 are in a state of electrical connection, the above described voltage is applied between the medium P and the liquid 4. The medium P is formed from a material which is itself electrically conductive may be used, and, for example a material surface coated with a mesh or thin film of a conductive material, such as a metal or resin, may also be used, or a surface coated with an electrically conductive liquid may also be used. For example, paper or the like surface coated with an aluminum mesh 46, as shown in (2) of FIG. 2, may be used.

There is an electrode pad 33 provided at one end of each of the individual electrodes 32, and the electrode pad 33 is connected by a lead, not illustrated, to a switching IC, also not illustrated. The piezo elements 30 are driven by a signal from the switching IC, controlling so as to deform/not deform the beam members 14.

The beam members 14 are able to be deformed in both the liquid droplet ejection direction and in the opposite direction thereto. The liquid 4 is supplied from a pool 24 provided within the holding member 18, and liquid droplets are ejected in the ejection direction due to inertia of the liquid 4 that has reached the nozzles 16 through the ducts 13 that are in communication with the pool 24.

The ejection liquid used here is a high viscosity liquid of extremely high liquid viscosity, in order to prevent bleeding on impact with the medium, to increase the optical color density, and to reduce the amount of water contained therein so that swelling due to wetting of the medium can be suppressed and the drying time can be reduced, or in order to increase the degrees of freedom in the overall design of such high quality inks. The ejection liquid is specifically one with a viscosity that greatly exceeds 20 cps, such as, for example, a high viscosity liquid of about 50 to 100 cps.

Ejection Principal

Figure 3A:
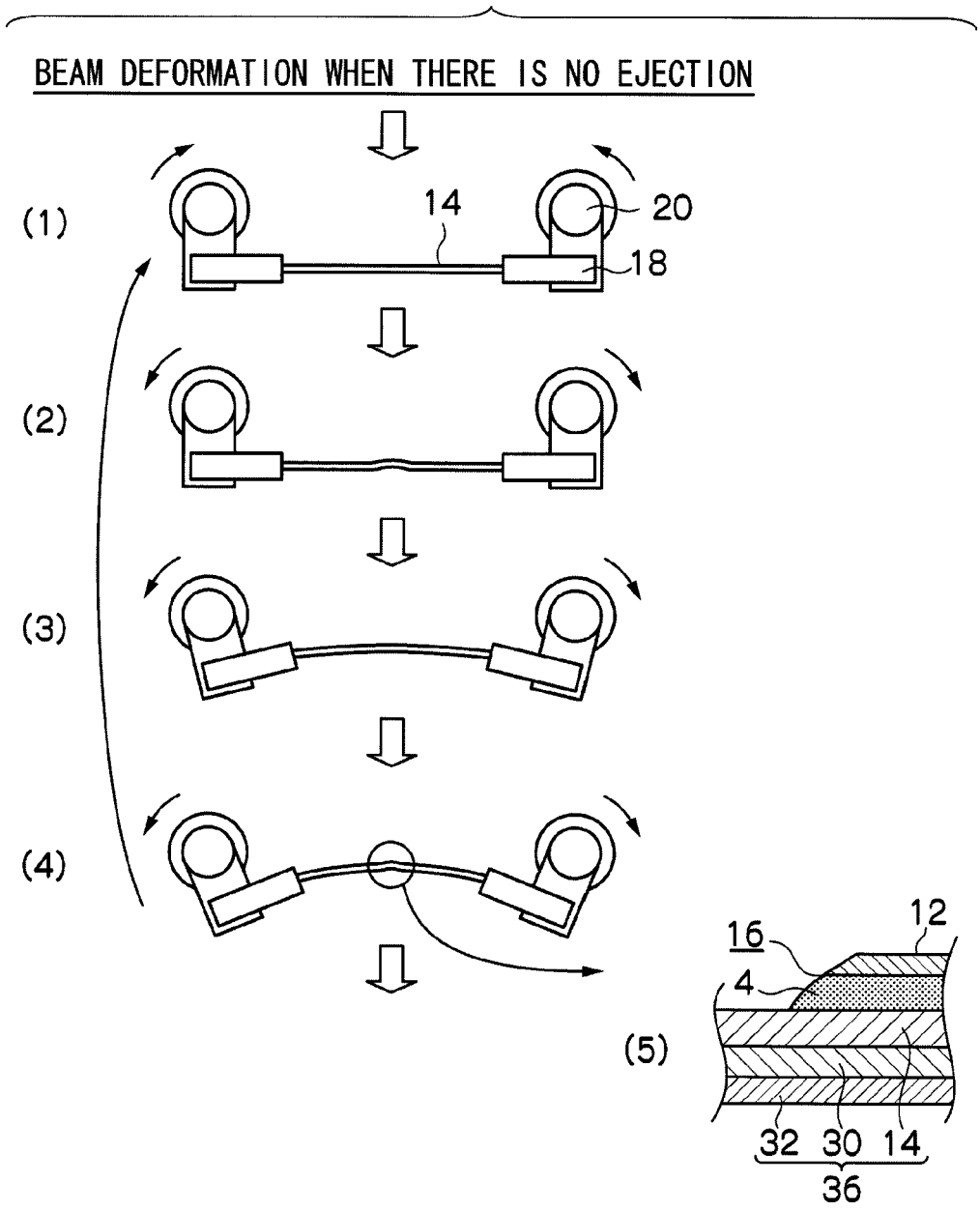
FIG. 3A is diagram showing beam deformation when there is no ejection from the liquid droplet ejection head according to an exemplary embodiment of the present invention.

Beam deformation in a case where the liquid droplet ejection head according to the first exemplary embodiment of the present exemplary embodiment does not eject is shown in FIG. 3A.

First the actuator 36 is not driven, and when not ejecting a droplet 2, as shown in (1) of FIG. 3A, the beam member 14 is in a pre-bent state toward the liquid droplet ejection direction (toward the top in the figure), and the actuator 36 is not driven since the signal instructing ejection is not sent by the switching IC.

When the rotation encoders 20 are rotated (pivoted) in the direction of the arrow, as shown in (2) of FIG. 3A, first a bend is generated in the ejection direction (toward the top in the figure), and since the beam member 14 is only bent in the liquid droplet ejection direction, the beam member 14 continues in a convex shape protruding facing the liquid droplet ejection direction from (3) of FIG. 3A up to (4) of FIG. 3A, until the maximum bend is reached.

Namely, in the interval of time the beam member 14 displaces from (1) of FIG. 3A up to (4) of FIG. 3A, the liquid 4 within the beam member 14 is not accelerated sufficiently in the ejection direction (toward the top in the figure), and therefore the droplet 2 is not (as shown in (5) of FIG. 3A) ejected from the nozzle 16.

The beam member 14 is then returned to its initial position, position (1) of FIG. 3A, by flattening the beam member 14 by reverse rotation of the rotation encoders 20 after stopping rotation at the point of maximum bend, shown in (4) of FIG. 3A.

Figure 3B:
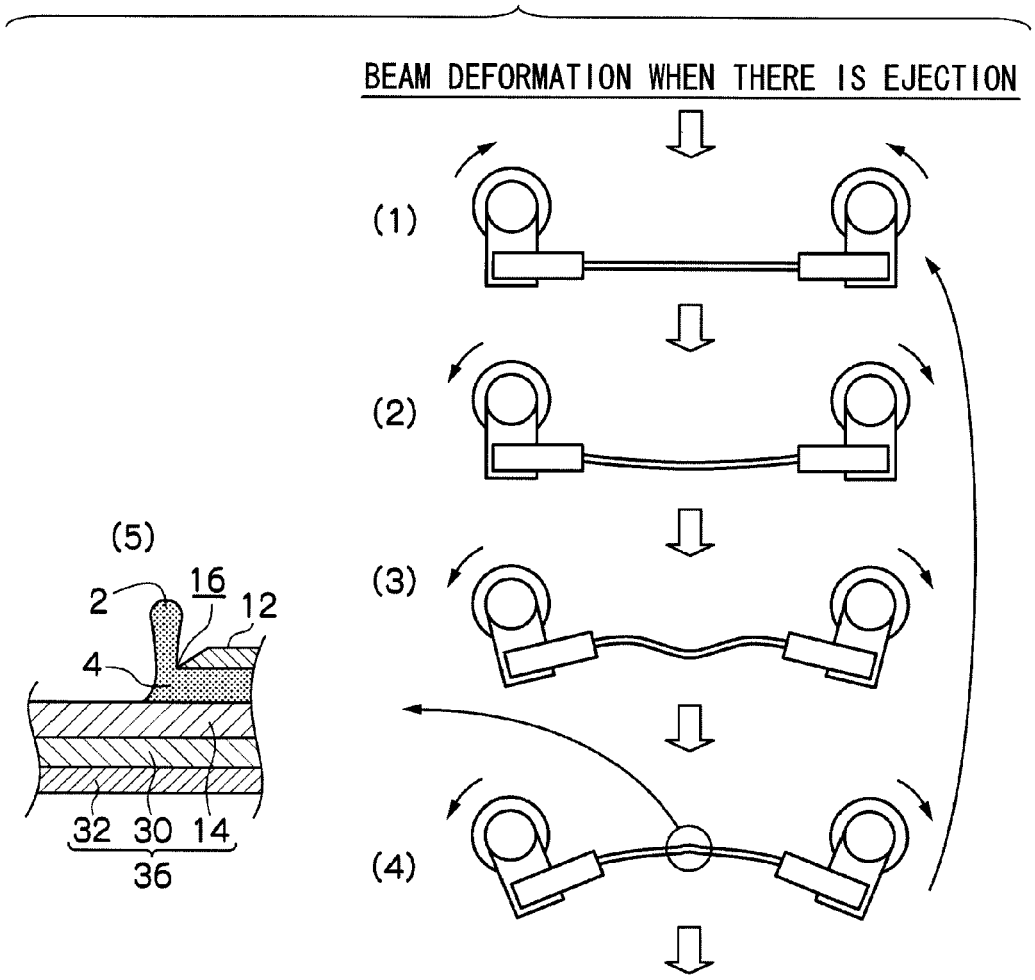
FIG. 3B is diagram showing beam deformation when there is ejection from the liquid droplet ejection head according to an exemplary embodiment of the present invention.

In contrast, when the actuator 36 is driven, a signal instructing ejection of the droplet 2 is sent by the switching IC and the actuator 36 is driven as shown in (2) of FIG. 3B, such that the beam member 14 is caused to adopt a bent state with a concave (indentation) facing the droplet 2 ejection direction (bending toward the bottom in the figures), and the rotation encoders 20 are rotated from the (2) of FIG. 3B to the (4) of FIG. 3B with a positive rotation (direction of the arrow in the figures), such that the bending direction of the beam member 14 changes and the portions of the beam member 14 near to the rotation encoder 20, namely both end portions of the beam member 14, come to bend in convex (protruding) shapes facing the ejection direction (toward the top in the figure).

As the change in bending direction progresses toward the center, at a given point in time a sudden reversal of the buckling of the beam member 14 occurs, with rapid deformation toward the droplet 2 ejection direction (toward the top in the figure) (the deformation of the central portion of the beam member 14 is shown exaggerated from (3) of FIG. 3B to (4) of FIG. 3B).

Since the nozzle 16 opened at the end portion of the flow channel member 12 is provided at a substantially central portion of the beam member 14 in the length direction, the liquid 4 that has reached the nozzle 16 is also displaced along with the deformation toward the ejection direction of the beam member 14 (toward the top in the figure) due to the buckling reversal, and is ejected from the nozzle 16 as the droplet 2 (see (5) of FIG. 3B).

The beam member 14 is then returned to its initial position by flattening the beam member 14 by reverse rotation of the rotation encoders 20 after stopping rotation at the point of maximum bend, shown in (4) of FIG. 3B.

It should be noted that while configuration is made in the above exemplary embodiment with the beam member 14 bent to form a concave facing the liquid droplet ejection direction (bent toward the bottom in the figure) when the actuator 36 is driven, causing buckling reversal and ejection of the droplet 2, configuration may also be made with the beam member 14 pre-bent into a concave shape facing the ejection direction when the actuator 36 is not driven so that the beam member 14 bends in a convex shape facing the ejection direction (bends upward in the figure) when the actuator 36 is driven. Control of whether or not the droplet 2 is ejected/not ejected may also be made in a similar manner in such a case by the presence or absence of a signal.

Displacement due to deformation in the above described buckling reversal is considerably larger in comparison to displacement with a normal actuator, and sufficient ink droplet 2 ejection is possible even with the high viscosity ink used in the present invention.

Operation and Effect

Figure 4:
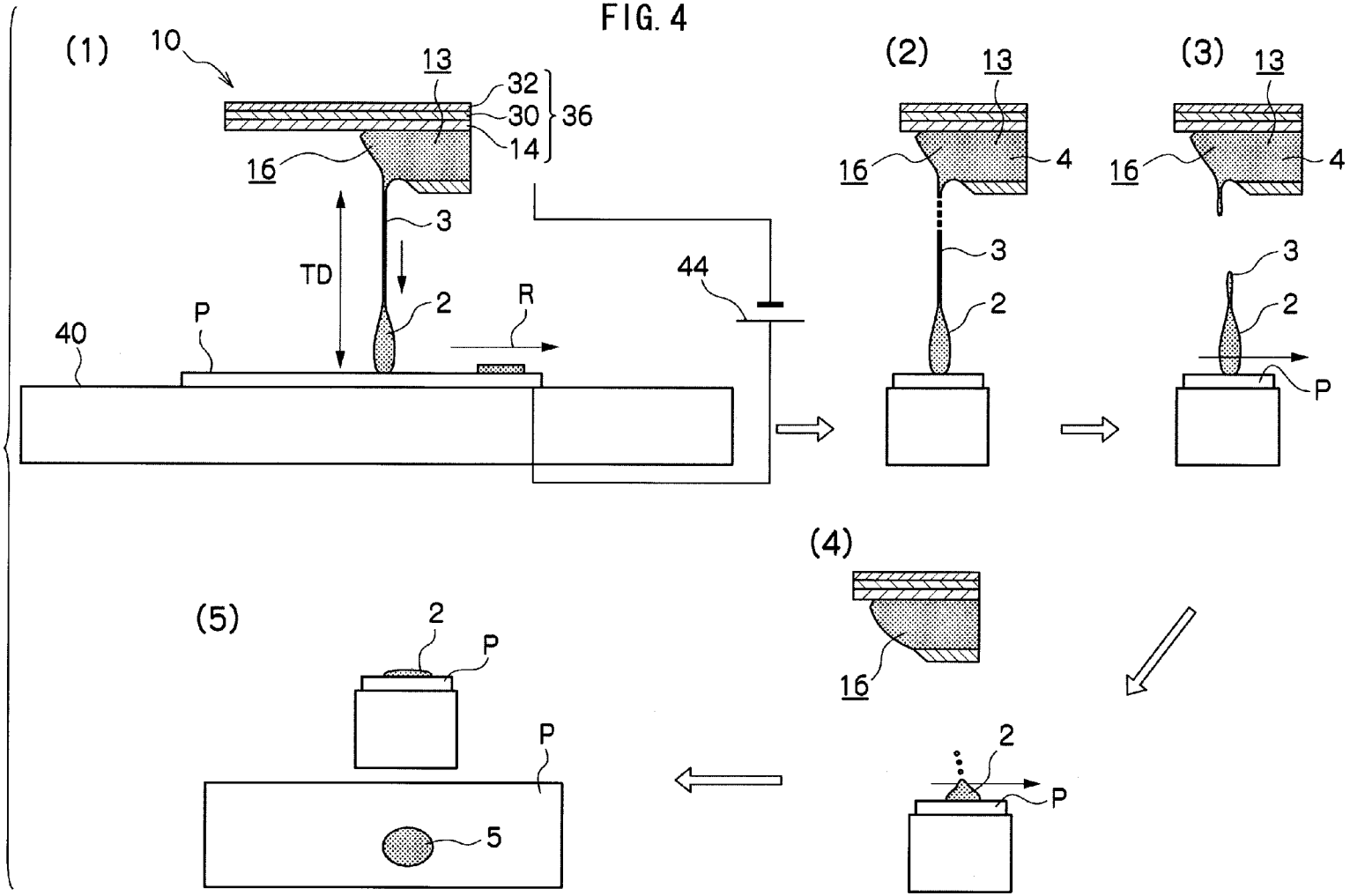
FIG. 4 is a diagram showing effects of suppression of drawing out of a tail and an improved impact shape in a liquid droplet ejection head according to an exemplary embodiment of the present invention.

The relationship between the tail drawn out from a liquid droplet, the movement of a medium, and the shape of impact in a liquid droplet ejection head according to the first exemplary embodiment of the present invention is shown in FIG. 4.

As shown in FIG. 4, the high viscosity droplet 2 is ejected from the nozzle 16 of the liquid droplet ejection head 10, and flies toward the opposing medium P. It can be seen that when this occurs there is a tail 3 formed between the surface of the liquid in the nozzle 16 and the droplet 2, due to the high viscosity of the droplet 2.

Figure 7:
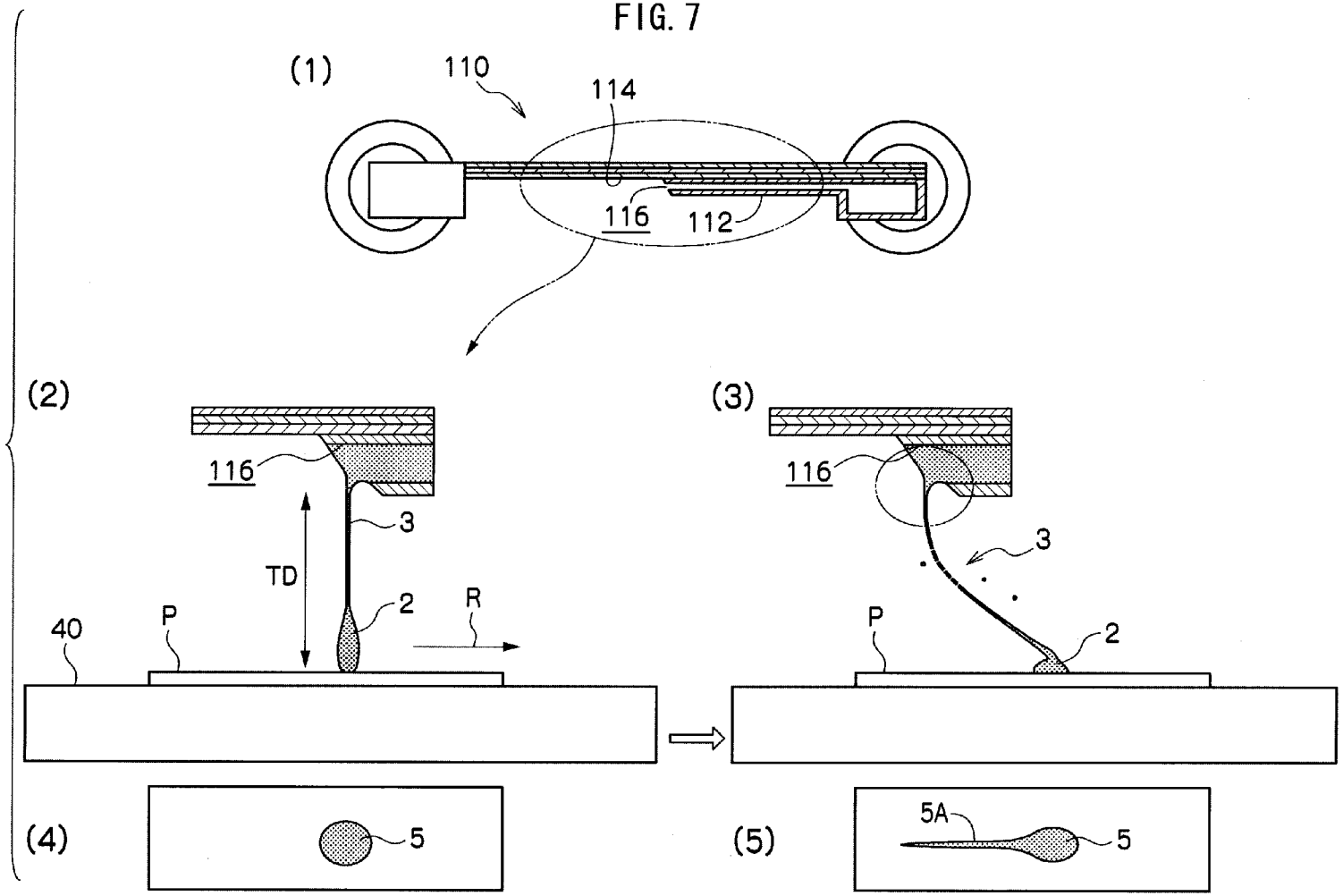
FIG. 7 is a diagram showing the relationship of droplet impact shape in a conventional liquid droplet ejection head.

In a conventional ejection head, such as shown in FIG. 7, the following problem arises. If, say, the distance TD (throw distance) between the nozzle 116 and the medium P of (2) of FIG. 7 is 1 mm, and the flight speed of the ejected droplet is 5 m/s, the tail 3 is formed between the medium P and the nozzle 116 in a 200 μs interval before impact. However, after that the drawing out of the tail 3 from the nozzle 116 to ward the medium P persists, since the tail 3 does not cut off.

Since drawing out of the tail 3 in the direction of the medium P continues even after 200 μs have elapsed from ejection from the nozzle 116, there is a delay from when ejection is finished until the liquid surface (meniscus) of the nozzle 116 settles. The refilling in the vicinity of the nozzle 116 is therefore also delayed, and this sometimes means that it is difficult to achieve ejection with a high frequency.

The above described tail 3 also effects the impact shape due to the conveying of the medium P in the direction shown by arrow R in (2) of FIG. 7. Namely, if the medium P were to be in a stationary state as shown in (4) of FIG. 7 the impact shape 5 would be near to circular, however, since the droplet 2 impacts the medium P while the medium P is being conveyed, the impact shape 5 has an impact shape shaped like a tadpole, with a tail 5A drawn out toward the back in the conveying direction, sometimes influencing image quality.

To address this issue, the present invention uses a configuration in which a specific voltage is applied using the electrical supply 44 between the beam members 14 (common electrodes) and the medium P, as shown in (1) of FIG. 4, such that there is electrical conductivity between the droplet 2 which has impacted on the medium P and the liquid 4 within the nozzle 16. The medium P may be made conductive by coating a thin film thereon, such as an aluminum coat or a resin coat. Prior application may also be made of an electrically conductive liquid.

It is known that if the viscosity of the liquid 4 is 100 cps then the length of the tail 3 is about 1 mm, with instances of 1 mm being exceeded. If the distance TD between the nozzle 16 and the medium P is 1 mm, then it is possible to short circuit the nozzle 16 and the medium P by electrical conduction at the same time as the leading edge of the droplet 2 impacts. It is necessary to make TD several hundreds of μm in order to prevent unintentional shorting when there is foreign matter present in the gap between the nozzle 16 and the medium P.

As shown in (2) of FIG. 4, heat is generated by electrical conduction in the thinnest portion of the tail 3, toward the rear end in the flight direction, and the tail 3 separates due to solvent evaporation, separating the droplet 2 from the nozzle 16. Next, as shown in (3) of FIG. 4, when the droplet 2 is completely separated from the liquid 4 within the nozzle 16 accompanying the conveying of the medium P, the liquid 4 on the nozzle 16 side is pulled back within the duct 13. Stabilization of the liquid surface (meniscus) of the nozzle 16 is thereby accelerated, as shown in (4) of FIG. 4, and it becomes possible to eject with a high frequency without delay in the refilling in the vicinity of the nozzle 16.

Also, as shown in (5) of FIG. 4, the impact shape 5 is good and near to circular even with the medium P being conveyed, since the tail 3 is separated immediately after impact of the droplet 2.

A water-based ink is used in Liquid 4, using coloring material added at 2% to the base of a normal water-based ink, adjusted by the addition of sodium chloride, NaCl, within the range of several hundredths of a percent up to several tenths of a percent, thereby reducing the electrical resistance. The ink used in the present exemplary embodiment is one with sodium chloride is added at about 0.5%, and with an electrical resistance of $10^2$ Ωcm.

For high viscosity ink, in order to adjust the viscosity thereof, for example, the ink may be adjusted by mixing 2 parts of glycerin to 1 part of water, giving an adjusted viscosity of 20 cps, or adjusted by mixing 3 parts of glycerin to 1 part of water, giving an adjusted viscosity of 50 cps, or adjusted by mixing 4 parts of glycerin to 1 part of water, giving an adjusted viscosity of 100 cps, or adjusted by adding even more glycerin therein to give an adjusted viscosity of 200 cps. Also a similar result may be obtained by mixing in polymers, such as polyethylene glycol or polypropylene glycol, within the range of about 2 to 4 parts of the polymer to 1 part of water to give a high viscosity ink of 20, 50, 100, or 200 cps. It should be noted that oil-based inks may also be used as long as similar viscosities, electrical resistance and surface tensions are achieved. For example an ink may be used with a main solvent of urethane acrylate, diluted with polyethylene glycol diacrylate to give an ink with a viscosity of 20 to more than 100 cps, adjusted to reduce the electrical resistance by adding tri ethanol amine and mono ethanol amine.

Figure 5:
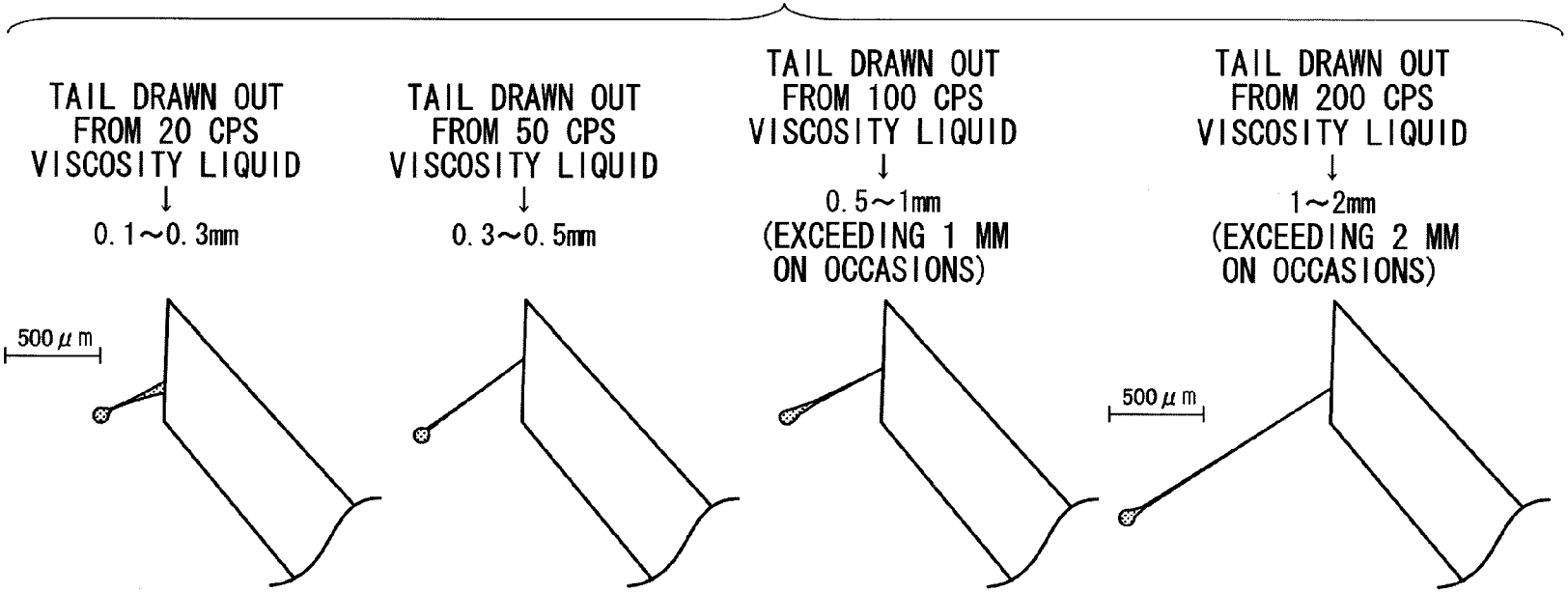
FIG. 5 is a diagram showing the relationship between the viscosity of liquid and length of tail drawn out in ejection with a liquid droplet ejection head according to an exemplary embodiment of the present invention.

FIG. 5 shows the relationship between the viscosity and tail length with the above viscosity liquids. Namely the lengths of the tails 3 generated during ejection of the droplet 2 are shown for each viscosity when the viscosity of the liquid 4 is changed by varying the amount of glycerin contained in the liquid 4.

These measurements are made using high speed photography of the length of the tail 3 when the length of the beam member 14 is 10 mm, the movement distance of the nozzle 16 with the buckling reversal is 3 mm, and the viscosity of the liquid 4 is varied from 20 to 200 cps.

As shown in FIG. 5, the tail length is about 0.1 to 0.3 mm when the viscosity is 20 cps, about 0.3 to 0.5 mm when the viscosity is 50 cps, about 0.5 to 1 mm when the viscosity is 100 cps, with the length exceeding 1 mm on occasions. The tail length is about 1 to 2 mm when the viscosity is 200 cps, with the length exceeding 2 mm on occasions.

As stated above, with this sort of situation, there is a delay from the time ejection finishes up to stabilization of the liquid surface (meniscus) at the nozzle 16, and there is a delay refilling in the vicinity of the nozzle 16, with this impeding ejection with a high frequency. The impact shape 5 is also shaped like a tadpole with a tail drawn out in the conveying direction, with this having a possible influence on the image quality.

Voltage Application and Impact Shape

Figure 6A:
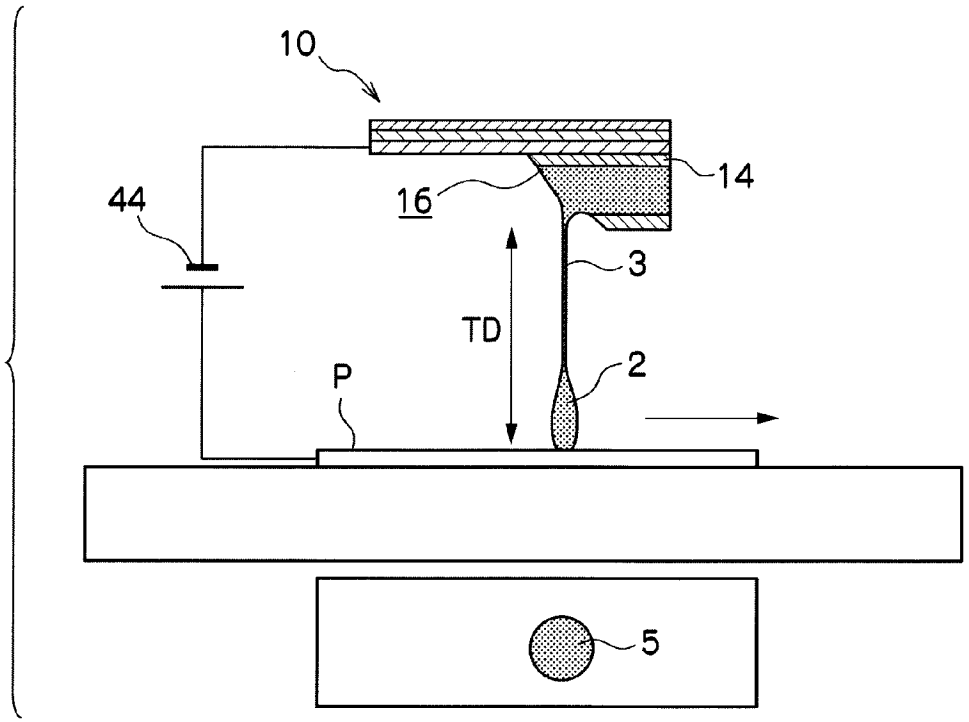
FIG. 6A is a diagram showing the relationship between voltage applied and droplet impact shape in a liquid droplet ejection head according to an exemplary embodiment of the present invention.

FIG. 6A shows changes in impact shape when the application voltage is varied in a liquid droplet ejection head according to an exemplary embodiment of the present invention.

A comparison is made here of the impact shape 5 when the application voltage is varied from 0 to 200 V, with the viscosity of the liquid 4 at 100 cps, TD at 1 mm, the length of the beam member 14 at 10 mm, the movement distance of the nozzle 16 at 3 mm, and the frequency of ejection at 20 Hz.

Voltage is applied between the beam member 14 and the medium P using the electrical supply 44, as shown in FIG. 6A. The ideal impact shape 5 of the ejected droplets 2 on the medium P is a substantially circular shape.

Figure 6B:
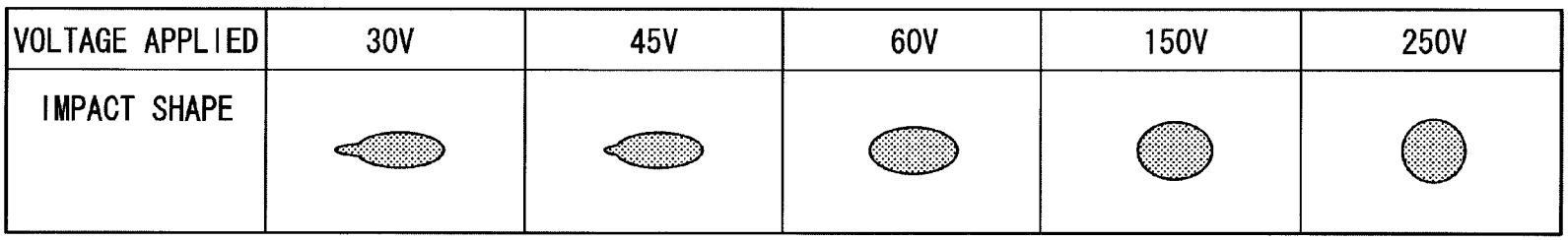
FIG. 6B is a diagram showing the change in impact shape of the droplet that has impacted on a medium when the voltage applied is changed in a liquid droplet ejection head according to an exemplary embodiment of the present invention.

Changes in the impact shape of the droplet 2 that has impacted on the medium P when the application voltage is changes as described above are shown in FIG. 6B. There is some effect shown when the application voltage is less than 30V (for example 15V) in comparison to with no voltage applied (OV, tadpole impact shape), however the impact shape 5 is unstable.

A clear effect of shortening the tail 5A is seen at an application voltage of about 30V to 45V, and as the application voltage is then increased from 60V to 200V the shortening effect on the tail 5A increases with increase in voltage, and an improvement in the shaping effect on the impact shape 5 is seen. The values of these application voltages are significantly smaller values in comparison to the several hundreds of V to several thousands of V used in electrostatic attraction methods in which droplets are attracted onto a medium using electrostatic charge, and effects are seen even at safe voltage values (42.4 V alternating current) classified as SELV (safety extra-low voltages) in IEC 60950 (J60950).

Electrical corrosion caused by differences in potential may also be avoided, since in the beam members 14 all the portions of the ducts 13 are in contact with the liquid 4, and configuration is made such that a uniform potential is applied to all portions of the ducts 13 at the same time. Preferably the beam members 14 here are formed from a corrosion resistant material, such as SUS, but electrical corrosion due to differences in potential may be further prevented by using a material such as one with a precious metal coating.

Other

It should be noted that the present invention is not limited to the exemplary embodiment described above.

For example, while in the above exemplary embodiment the nozzles 16 are provided formed by the cross-section at the end face of the flow channel members 12, a configuration may be made with the flow channel members 12 extending over the entire length of the beam members 14, and the nozzles 16 provided in the vicinity of the center of the beam members 14 in the length direction.

Alternatively, a configuration may be made in which there are no flow channel members 12 provided, and the liquid 4 is replenished by using beam members 14/actuators 36 which have the opposite side to the ejection side treated to attract the liquid 4, with the liquid 4 being drawn by capillary action so as to pass through the beam members 14/actuators 36.

In addition, the actuators were formed from piezo elements 30 and beam members 14, however, an actuator that bends and changes shape due to differential thermal expansion is suitable, using thermistors in place of the piezo elements 30, and actuators that use electrostatic force or magnetic force may also be used. Namely, other modes of actuator may be used.

The liquid droplet ejection head in the specification of the present invention is not limited to one used for recording characters and images on recording paper using ink or the like. In other words, the recording medium is not limited to paper, and the ejection liquid is not limited to ink. The present invention may be used in general liquid jetting apparatuses used in industry such as, for example, for forming a color filter for a display by ejecting ink onto a polymer film or glass, or for forming solder bumps for component mounting by ejecting liquid solder onto a substrate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention from various embodiments and with the various modifications as are suited to the particular use contemplated. It is intended that the scope of the invention be defined by the following claims and their equivalents.

What is claimed is:

1. A liquid droplet ejection head comprising a beam member that is deformed by buckling reversal such that a liquid droplet ejection face of the beam member becomes indented, and is subsequently deformed by buckling reversal such that the liquid droplet ejection face becomes protruded, and a nozzle that ejects the liquid droplet by inertia of the buckling reversal deformations, wherein a liquid droplet of an electrically conductive liquid is ejected from the head, which is provided with difference in potential between the head and an opposing medium, toward the medium, and electricity is conducted between the head and the medium through a tail of the liquid droplet.

2. The liquid droplet ejection head of claim 1, wherein the viscosity of the liquid is about 20 cps or greater.

3. The liquid droplet ejection head of claim 1, wherein the head comprises an electrically conductive member, the conductive member being exposed within a plurality of flow channels that supply the liquid to the head, and being in contact with the liquid, such that the liquid within all of the flow channels is at a uniform electrical potential by conduction with the conductive member.

4. The liquid droplet ejection head of claim 1, wherein the different electrical potential is at about 30V or greater.

5. The liquid droplet ejection head of claim 4, wherein the different electrical potential is at about 60V to about 200V.

6. A liquid droplet ejection device comprising the liquid droplet ejection head of claim 1.

7. A liquid droplet ejection head comprising:

a nozzle that ejects liquid droplets of an electrically conductive liquid from the head, which is provided with difference in potential between the head and an opposing medium, toward the medium;

an ink flow channel member that includes the nozzle;

a beam member that is in contact with the ink flow channel member;

holding members that support the beam at both ends thereof;

a rotation encoder that supports one or both ends of the holding member and rotates so as to compress the beam member, the rotation encoder deforming the beam member by buckling reversal by rotation of the rotation encoder such that a liquid droplet ejection face of the beam member becomes indented and the liquid droplet election face becomes protruded, providing the ink within the ink flow channel with inertia of the buckling reversal deformations in the ejection direction and ejecting an ink liquid droplet from the nozzle; and a power supply unit that conducts electricity between the head and the medium through a tail of the liquid droplet.

8. The liquid droplet ejection head of claim 7, wherein the power supply unit comprises:

a retention member that holds a medium on the holding member; and a power source that applies a specific voltage between the beam member and the holding member.

* * * * *